US005502930A

United States Patent [19]

Burkette et al.

[11] Patent Number: 5,502,930

[45] Date of Patent: Apr. 2, 1996

[54] LIVING HINGE PANEL CONNECTOR PROVIDING STACKABILITY OF LEVELS OF PANELS

[75] Inventors: Andrew J. Burkette; Timothy Packrall, both of Tampa, Fla.

[73] Assignee: Stellar Holdings, Inc., Tampa, Fla.

[21] Appl. No.: 176,033

[22] Filed: Dec. 30, 1993

[51] Int. Cl.[6] ..... E04B 2/74

[52] U.S. Cl. ..... 52/71; 16/225; 16/355; 16/DIG. 13; 52/239; 52/282.1; 52/285.4; 52/586.1; 52/585.1; 160/135

[58] Field of Search ..... 16/225, 355, 356, 16/DIG. 13; 52/71, 239, 266, 271, 281, 282.1, 282.5, 284, 285.4, 585.1, 586.1, 586.2, 282.2; 160/135, 231.1, 231.2

[56] References Cited

U.S. PATENT DOCUMENTS

| | | | |
|---|---|---|---|
| 1,697,277 | 1/1929 | Hoopes . | |
| 2,802,522 | 8/1957 | Collet | 160/84 |
| 3,084,403 | 4/1963 | Elmendorf | 20/15 |
| 3,132,432 | 5/1964 | Yee | 160/135 X |
| 3,403,720 | 10/1968 | Ahleen | 160/231.2 |
| 3,592,289 | 7/1971 | Aysta et al. | 181/30 |
| 3,854,269 | 12/1974 | Hancock | 52/282.1 X |
| 3,889,736 | 6/1975 | Firks | 160/135 |
| 4,004,387 | 1/1977 | Ellingson | 52/586.2 X |
| 4,021,973 | 5/1977 | Hegg et al. | 52/36 |
| 4,166,332 | 9/1979 | Donovan | 40/605 |
| 4,194,313 | 3/1980 | Downing | 40/610 |
| 4,232,724 | 11/1980 | Brown | 160/135 |
| 4,344,475 | 8/1982 | Frey | 160/135 |
| 4,375,829 | 3/1983 | Dorr et al. | 160/135 |
| 4,391,077 | 7/1983 | Giess | 52/281 X |
| 4,438,605 | 3/1984 | DeLucia | 52/71 |
| 4,531,564 | 7/1985 | Hanna | 52/585.1 X |
| 4,635,418 | 1/1987 | Hobgood | 52/239 |
| 4,711,046 | 12/1987 | Herrgord | 40/605 |
| 4,712,336 | 12/1987 | Backer | 52/71 |
| 4,777,777 | 10/1988 | Massimo | 52/586.2 |
| 4,785,565 | 11/1988 | Kuffner | 160/135 X |
| 4,821,787 | 4/1989 | Swanson | 160/135 |
| 4,825,930 | 5/1989 | Lindberg et al. | 160/135 |
| 4,830,080 | 5/1989 | Densen | 160/135 |
| 4,873,776 | 10/1989 | Hoffart | 40/572 |
| 4,935,995 | 6/1990 | Daus, Jr. | 24/573.1 |
| 4,968,171 | 11/1990 | Shell | 403/4 |
| 5,092,385 | 3/1992 | Beaulieu | 160/135 |
| 5,131,448 | 7/1992 | Miller | 160/135 |
| 5,133,108 | 7/1992 | Esnault | 160/231.2 X |
| 5,242,241 | 7/1993 | Nelson | 160/135 X |
| 5,339,576 | 8/1994 | Fussler | 52/71 |

FOREIGN PATENT DOCUMENTS

| | | | |
|---|---|---|---|
| 3842024 | 6/1990 | Germany | 52/71 |

OTHER PUBLICATIONS

Brochure "The Elegant Modular Exhibit System" by Nimlock Exhibit Systems (6 pages).

*Primary Examiner*—Carl D. Friedman
*Assistant Examiner*—Kevin D. Wilkens
*Attorney, Agent, or Firm*—Hodgson, Russ, Andrews, Woods & Goodyear

[57] ABSTRACT

A living hinge panel connector for a pair of panels which provides stackability therewith of another pair of panels. A hinge member has a pair of first formations for connecting to a pair of panels respectively, a second formation for stackingly connecting the pairs of panels wherein opposite end portions of a pin are press-fit within bores of the second formations of the hinge members for the pairs of panels respectively, and a pair of flexible webs connecting the second formation to the first formations respectively. The pin has a collar intermediate the ends to define the end portions for preventing the pin from sliding so deep into a bore that it cannot be easily removed therefrom.

17 Claims, 2 Drawing Sheets

FIG. 5
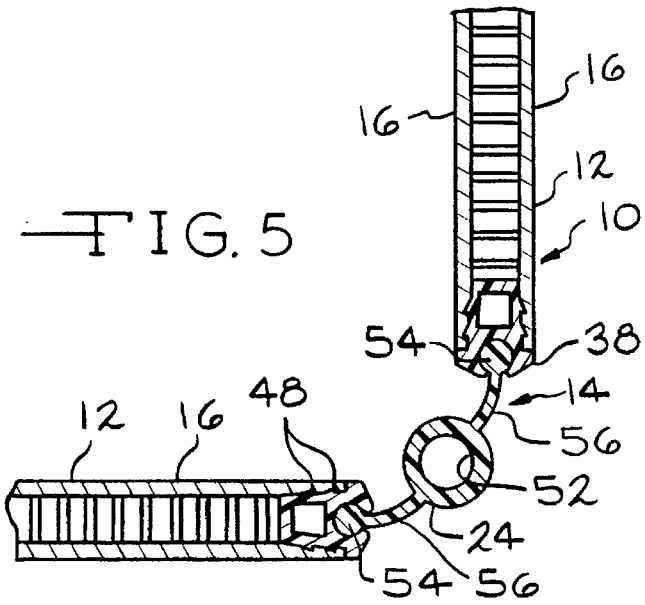
FIG. 6
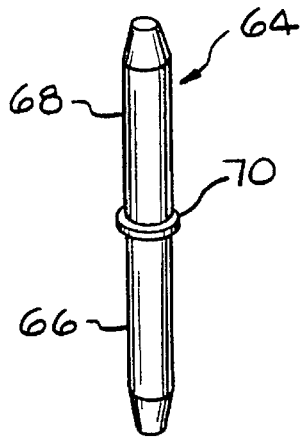
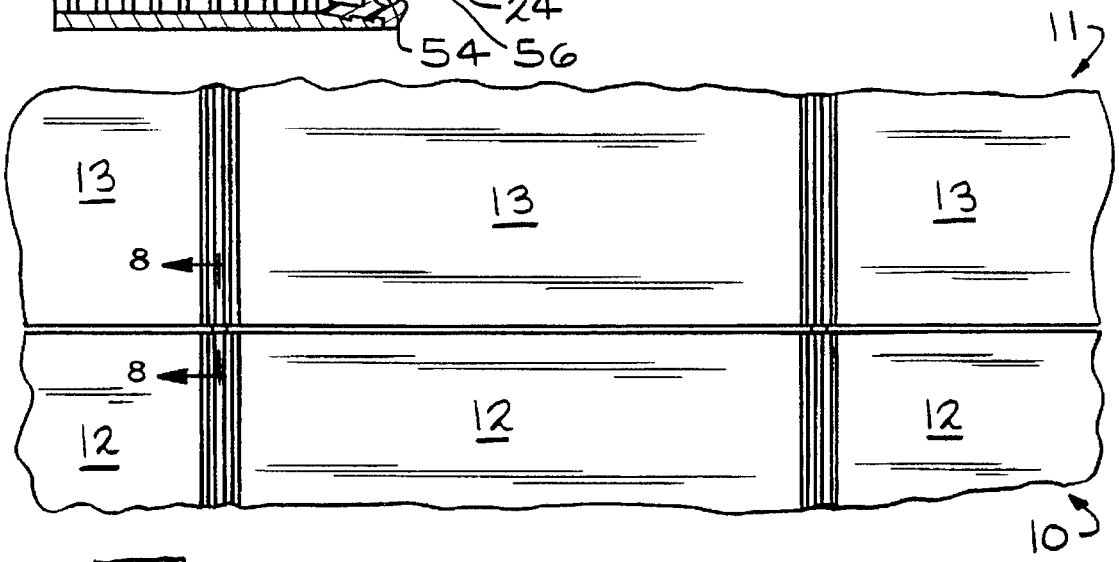
FIG. 7
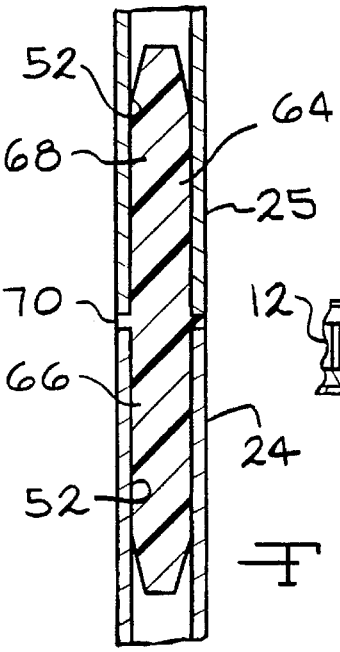
FIG. 8
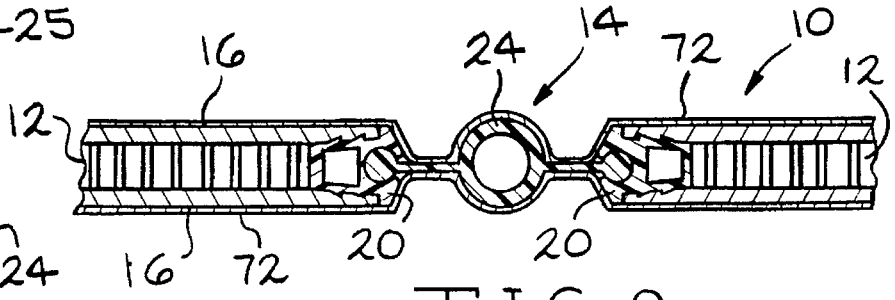
FIG. 9

LIVING HINGE PANEL CONNECTOR PROVIDING STACKABILITY OF LEVELS OF PANELS

The present invention relates generally to panel display structures for trade show exhibition booths and the like. More particularly, the present invention relates to apparatus for connecting panels together to form such structures.

U.S. Pat. No. 3,889,736 to Firks discloses a panel connector which has a reduced thickness flexible portion which allows one panel to be moved to various orientations relative to the panel to which it is connected. Other hinged joiner strips are disclosed in U.S. Pat. Nos. 3,592,289; 4,375,829; and 4,830,080. Hinged connectors composed of a cardboard material may tend to wear rapidly.

Examples of other hinged panel connection assemblies and the like are found in U.S. Pat. Nos. 1,697,277; 2,802,522; 3,084,403; 4,021,973; 4,166,332; 4,194,313; 4,344,475; 4,873,776; 4,635,418; 4,711,046; 4,821,787; 4,935,995; 4,968,171; and 5,092,385.

In a Nimlink display and exhibit system provided by Nimlok Company, a link connecting a pair of panels has a length to also serve as a vertical connector for stacking another pair of panels thereto.

Not only is it desirable to provide living hinges between panels in a display but also to vertically stack sets of panels. Stacking has been provided by pins the end portions of which are press fit in bores of members associated with upper and lower sets of panels respectively. For example, a system provided by American Display Company includes an elongate member of square cross-section positioned between the respective edges of a pair of panels and spaced perhaps ½ inch from each of the edges. The panels are permanently hingedly connected so that they are foldable by means of cloth which is adhesively attached to the panel faces and is also adhesively attached to itself and to the respective sides of the member. The member adds body to the hinge. A pair of rods may be contained within the member and extend from an end thereof perhaps 3 inches for insertion in another member for another set of panels to permit stacking of panels.

It is an object of the present invention to provide a dependable living hinge for a pair of panels which also provides stackability with another pair of panels.

It is another object of the present invention to provide such a living hinge which is long-lasting and inexpensive.

It is further object of the present invention to provide for easy removal of a stacking pin therefor.

In accordance with the present invention, an elongate connector member has a pair of elongate first formations for connecting to connector members in elongate edge portions of a pair of panels respectively, an elongate second formation for stackingly connecting the pair of panels to another pair of panels, and a pair of flexible webs connecting the second formation to the first formations respectively. In accordance with another aspect of the present invention, a stacking pin insertable at its ends into respective bores in the second formations of a pair of the connector members for stacking two sets of panels has a collar intermediate the ends to keep the pin from sliding too far into one of the bores.

The above and other objects, features, and advantages of the present invention will be apparent in the following detailed description of the present invention taken in conjunction with the accompanying drawings wherein the same reference numerals depict the same or similar parts throughout the several views.

BRIEF DESCRIPTION OF THE DRAWINGS

FIG is a perspective view of one member of a connector assembly which embodies the present invention.

FIG. 5 is a view similar to that of FIG. 4 illustrating bendability of the connector member of FIG. 1.

FIG. 6 is a perspective view of a stacking pin for the connector assembly.

FIG. 7 is an elevation view of a plurality of connected panels stackingly connected with another plurality of connected panels.

FIG. 8 is a partial sectional view thereof taken along lines 8—8 of FIG. 7.

FIG. 9 is a view similar to that of FIG. 4 with the panel assembly finished with a cloth covering.

DETAILED DESCRIPTION OF THE PREFERRED EMBODIMENT

Figure 1:
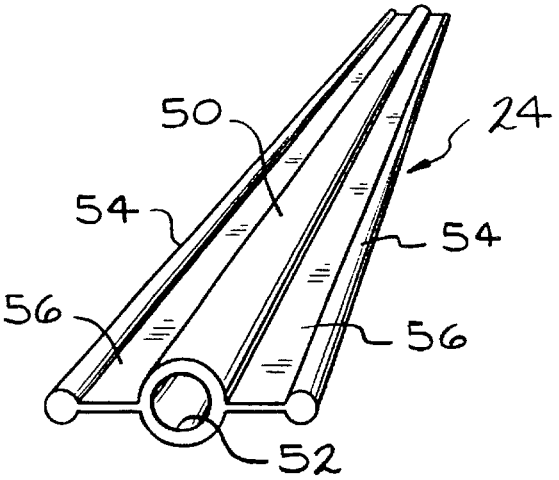
Figure 2:
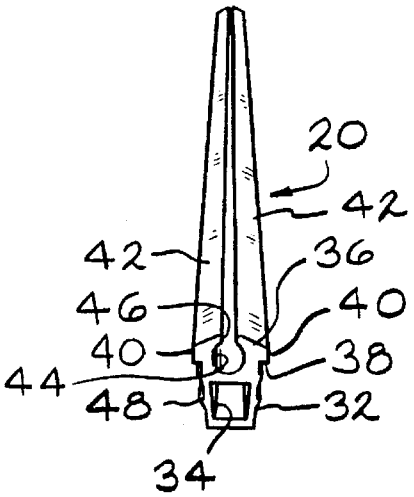
FIG. 2 a perspective view of one of two identical additional members of the connector assembly.
Figure 3:
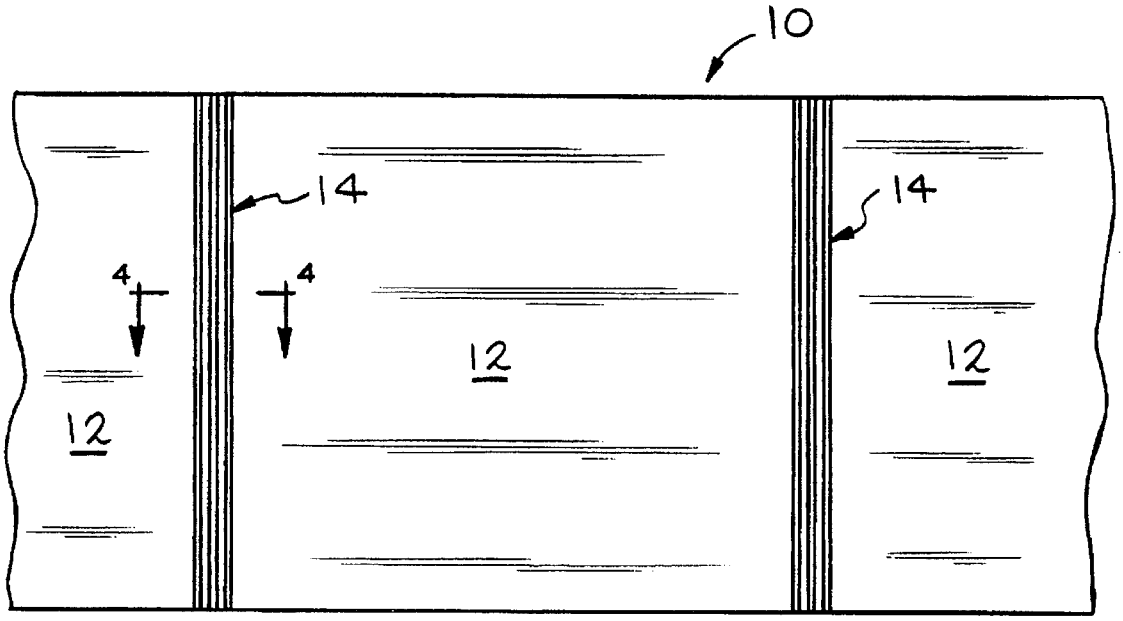
FIG. 3 is an elevation view of a panel assembly which contains the connector assembly.
Figure 4:
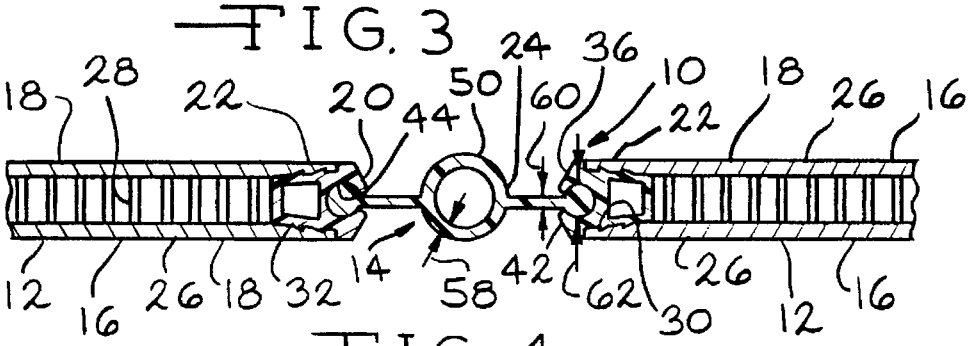
FIG. 4 is a partial sectional view of the panel assembly taken along lines 4—4 of FIG. 3.

Referring to FIGS. 1 to 5, there is illustrated generally at 10 an assembly of a set of three panels 12 each pair of which is connected by a connector assembly 14. The panels may, for example, be a ½ inch lightweight honeycomb material having dimensions of 44 inches by 22 inches or may be otherwise suitably composed and dimensioned. The faces 16 may be covered with a suitable fire-retardant foil, illustrated at 18.

The panels 12 are connected edge-to-edge. The connector assembly 14 includes a pair of elongate first connector members or receivers 20 mounted in the edge portions 22 respectively of a pair of panels 12 and further includes an elongate second connector member or hinge 24 connected to the first connector members 20. The connector members 20 and 24 may be composed of extruded polyvinylchloride (PVC) or any other suitable plastic. Each of the members 20 and 24 is composed of a single piece of material. First connector members 20 may alternatively be composed of, for example, extruded aluminum, steel, or carbon, or any other suitable material. Second connector members 24 may alternatively be composed of any other suitable material which provides the desired flexibility and rigidity as described hereinafter.

Each of the panels 12 is composed of a pair of parallel sheets 26 defining the faces 16 and corrugations 28 therebetween. A groove 30 is provided in each edge portion 22 between the sheets 26, and an elongate first or retainer portion 32, which is generally rectangular in cross-section, of first connector member 20 is pressed or slid into the groove 30 over the length thereof and is sized to fit tightly therein. The portion 32 may have a generally rectangular hollow or bore 34 extending through its length to lighten the member 20 and may also aid in sliding or pressing of the member 20 into the groove.

An elongate second portion 36 of first member 20 has an increased width to provide a shoulder 38 to engage the edges of sheets 26 and thereby fix the location of the first member 20 relative to the panel 12. The second portion 36 is shaped to have a pair of walls 40 which are generally normal to shoulder 38 to extend for a short distance in line with sheets 26 and a pair of walls 42 which extend therefrom and converge toward each other so that the second portion 36 has a generally "housetop" shape. A bore 44, which is circular in section, extends through the length of the second portion 36, and a slot 46 passes through the second portion 36 over the length thereof between the converging ends of the walls 42 to the bore 44 thereby providing communication between the bore and the exterior of the member 20.

The retainer portion 32 has a greater width at the shoulder 38 and tapers slightly therefrom for ease of insertion. The side walls thereof have longitudinal ridges 48 to create a holding bite with the panel sheets 26. The receivers 20 are permanently installed in the grooves 30 such as by hot-melting in place.

The second member or hinge 24 includes an elongate cylindrical portion 50 having a cylindrical bore 52 extending through the length thereof. Hinge 24 also includes a pair of elongate solid cylindrical portions 54 which are sized to be snugly received in bores 44 respectively. A pair of elongate webs or thin membrane portions 56 connect the portions 54 to portion 50 and are received in slots 46 to extend from portions 54 through the slots 46 and thus out of receiver members 20 to thus form a hinge between the respective panels 12.

The thickness, illustrated at 58, of cylindrical portion 50 is relatively large so that portion 50 is rigid while the thickness, illustrated at 60, of the webs 56 is relatively small so that the webs 56 are flexible. The thickness (diameter), illustrated at 62, of portions 54 is also relatively large for rigidity thereof. For example, the hinge member 24 may be composed of PVC, the thickness 60 of the webs 56 may perhaps be about 1/32 inch, and the thicknesses 58 and 62 may perhaps be about 1/16 inch and 3/16 inch respectively. A plastic such as PVC may flex on the order of 1,000 times before breaking due to fatigue and allows the hinge to retain its shape over a long period of time. The length of each of the webs 56 may perhaps be about 3/8 inch. The outer diameter of portion 50 may perhaps be about 1/2 inch. Its inner diameter may thus be about 3/8 inch. As illustrated in FIG. 5, the thin webs 56 may flex to adjust the orientation of the panels 12 relative to each other. The webs 56 may be sufficiently flexible for orientation of the webs 56 through about 360 degrees relative to each other.

Referring to FIGS. 6, 7 and 8, a pin 64 is provided for removable insertion by press-fitting of opposite end portions 66 and 68 thereof in the bores 52 of hinge member 24 and another hinge member 25 for another level or set 11 of panels 13 for stacking of the set of panels 13 relative to the set of panels 12 so that different structures and configurations may be formed. Thus, the diameter of the pin 64 is substantially equal to the diameter of the bore 52.

The pin 64 is suitably cost-effectively machined from PVC or other suitable plastic material to have a collar 70 intermediate (preferably midway) its ends to define the end portions 66 and 68. The collar is provided to keep the pin 64 from being pushed into the bore 52 so far that it is difficult to remove it.

The pin 64 may, for example, have a length of perhaps about 3½ inches with the collar 70 midway between the ends. The ends over a distance of perhaps about ¼ inch may be tapered from a diameter of about 3/8 inch to allow easier insertion. The collar 70 may have a diameter of perhaps about ½ inch and a thickness (in the longitudinal direction of the pin) of perhaps about 3/32 inch.

The hinge assembly is preferably permanently attached to the panels. Referring to FIG. 9, the faces 16 of the panels 12 are each covered with cloth 72 which extends across the space between the panels to cover the face of the correspondingly adjacent panel. The cloth is adhesively attached to the panel faces and may be adhered to the hinge member 24 by suitable means such as a high contact cement. Excess cloth may be tucked between the panel sheets and the receiver 20.

Thus, the present invention allows a set of panels to be oriented as desired relative to each other and to be easily folded for storage and transport and unfolded for use and allows other sets of panels to be easily stacked therewith.

Although the invention has been described in detail herein, it should be understood that the invention can be embodied otherwise without departing from the principles thereof, and such other embodiments are meant to come within the scope of the present invention as defined by the appended claims.

What is claimed is:

1. An assembly for connecting a pair of panels comprising a pair of elongate first connector members, means for mounting said first connector members in elongate edge portions respectively of the panels, an elongate second connector member comprising a pair of elongate first formations for connecting said second connector member to said first connector members respectively, an elongate second formation having a pair of end portions, a pair of flexible webs connecting said second formation to said first formations respectively, and a pin, at least one of said end portions having a bore means for press-fittingly receiving an end portion of said pin.

2. An assembly according to claim 1 further comprising means for limiting distance of movement of said pin into said bore means, said limiting means comprising a collar on said pin which is intermediate ends of said pin.

3. An assembly according to claim 1 wherein said second formation has a rigid tubular shape.

4. An assembly according to claim 1 wherein said first formations are rigid and cylindrical in shape, each of said first connector members having a bore for receiving a respective one of said first formations and a slit extending longitudinally along and into said first connector member to said bore for receiving a respective one of said webs for providing access of said respective first formation to said respective bore.

5. An assembly according to claim 1 wherein said second connector member is composed of a single piece of material, said second formation and said webs having thicknesses such that said second formation is rigid and said webs are flexible.

6. An assembly comprising at least one pair of panels, means for connecting said panels including a pair of elongate first connector members mounted in elongate edge portions respectively of said panels, an elongate second connector member comprising a pair of elongate first formations for connecting said second connector member to said first connector members respectively, an elongate second formation having a pair of end portions, a pair of flexible webs connecting said second formation to said first formations respectively, and a pin, at least one of said end portions having a bore means for press-fittingly receiving an end portion of said pin.

7. An assembly according to claim 6 wherein said pin has a collar defining said end portions thereof.

8. An assembly according to claim 6 wherein said second formation has a rigid tubular shape.

9. An assembly according to claim 6 wherein said first formations are rigid and cylindrical in shape, each of said first connector members having a bore for receiving a respective one of said first formations and a slit extending longitudinally along and into said first connector member to said bore for receiving a respective one of said webs for providing access of said respective first formation to said respective bore.

10. An assembly according to claim 6 wherein said second connector member is composed of a single piece of material, said second formation and said webs having thicknesses such that said second formation is rigid and said webs are flexible.

11. An assembly according to claim 6 wherein each of said panels has a pair of faces, the assembly further comprising cloth material covering one of said faces of one of said panels and extending therefrom to and covering one of said faces of another of said panels.

12. An assembly according to claim 6 wherein the flexibility of said webs is such that one of said panels may be oriented relative to another of said panels through about 360 degrees.

13. An assembly for connecting a first pair of panels and for stackingly connecting the first pair of panels to a second pair of connected panels comprising first means for hingedly connecting the first pair of panels, said first connecting means including an elongate first rigid portion having a pair of end portions and a first bore in at least one of said end portions, second means for connecting the second pair of panels, said second connecting means including a second elongate rigid portion having a pair of end portions and a second bore in at least one of said second rigid portion end portions, an elongate pin having a pair of end portions, said pin end portions being sized to be press-fit in said first and second bores respectively for stacking the first and second pairs of panels, and means for limiting distance of movement of said pin into said bores, said limiting means comprising a collar on said pin which is intermediate ends of said pin.

14. An assembly according to claim 13 wherein said first connecting means further includes a pair of elongate formations for connecting said first rigid portion to said first pair of panels respectively and a pair of flexible webs connecting said first rigid portion to said pair of formations respectively.

15. An assembly according to claim 14 wherein the flexibility of said webs is such that one of the first panels may be oriented relative to another of the first panels through about 360 degrees.

16. An assembly according to claim 14 wherein said first rigid portion, said formations, and said webs are composed of a single piece of material, said first rigid portion and said webs having thicknesses such that said first rigid portion is rigid and said webs are flexible.

17. An assembly according to claim 14 wherein said first rigid portion has a tubular shape.

* * * * *